US007476792B1

(12) United States Patent
Musser

(10) Patent No.: US 7,476,792 B1
(45) Date of Patent: Jan. 13, 2009

(54) VERSATILE FINGER RING GUITAR SLIDE WITH VARIABLE BAR LENGTH

(76) Inventor: James Musser, 20725 Pennsylvania Ave., #C20, Lomita, CA (US) 90717

( * ) Notice: Subject to any disclaimer, the term of this patent is extended or adjusted under 35 U.S.C. 154(b) by 0 days.

(21) Appl. No.: 11/481,343

(22) Filed: Jul. 6, 2006

(51) Int. Cl.
*G10D 3/00* (2006.01)

(52) U.S. Cl. ..... 84/315

(58) Field of Classification Search ..... 84/315–319, 84/320–322, 453
See application file for complete search history.

(56) References Cited

U.S. PATENT DOCUMENTS

| | | | | |
|---|---|---|---|---|
| 4,817,488 | A * | 4/1989 | de los Santos | 84/319 |
| D324,532 | S | 3/1992 | Pearse | |
| D360,647 | S | 7/1995 | Jiminez | |
| 5,458,036 | A | 10/1995 | Monaco | |
| 5,515,762 | A | 5/1996 | Perkins et al. | |
| 6,111,177 | A | 8/2000 | Patillo | |
| D434,065 | S | 11/2000 | Morse | |
| 6,160,212 | A | 12/2000 | Morse | |
| 2005/0045019 | A1 | 3/2005 | Wright | |

FOREIGN PATENT DOCUMENTS

| | | | | |
|---|---|---|---|---|
| GB | 2366443 | A * | 3/2002 | 84/315 |

* cited by examiner

*Primary Examiner*—Kimberly R Lockett
(74) *Attorney, Agent, or Firm*—J. E. McTaggart

(57) ABSTRACT

A metal guitar slide ring, for playing a stringed musical instrument such as a guitar in a slide style, is configured to accept insertion of a musician's finger and still allow the fingertips to remain flexible and free to play instrument strings. The ring is configured with non-parallel ends so that the effective slide bar length that contacts the strings can be varied by the musician by rotating the ring about the finger. The range of adjustment along with the capability of wearing a plurality of rings simultaneously enable a musician to play up to 12 possible intervals on a guitar without retuning compared to 4 intervals with a conventional guitar slide. At least a portion of the ring may be coated with a hard smooth slide surface for substantially improved playing qualities, aesthetically appealing appearance, and superior comfort.

23 Claims, 4 Drawing Sheets

VERSATILE FINGER RING GUITAR SLIDE WITH VARIABLE BAR LENGTH

FIELD OF THE INVENTION

The present invention relates to an improvement in the field of stringed musical instruments, and more particularly to a finger slide ring structure that enables a musician to vary the effective slide bar length and thus the number of strings contacted, while leaving the musician's fingers and fingertips available for fingerboard fretting. Using one or more additional slide rings, each on a different finger, the musician can slide-stop additional fret positions and thus play intervals that are normally unavailable in slide playing mode.

BACKGROUND OF THE INVENTION

A common playing style for stringed instruments of the lute family, especially guitars, involves the use of a glass or metal slide bar to "stop" the strings for pitch as an alternative to pressing the strings against a fingerboard or fret.

Originally, a glass bottleneck was used to achieve different sound affects in stylizing a player's musical composition. Slide bars made from metal have been developed in a broad range, providing varying sound effects. Depending upon the size, material composition and/or design of the slide bar or slide ring, different sound effects may be produced.

Despite the widespread usage of metal slide bars in the playing of stringed instruments, a number of problems have also come from their bulky construction and the acoustic properties of metal. Regular size slide bars involve fully inserting one of the musician's fingers inside the bar. This does not allow the musician to flex his or her fingers while playing or to use the fingertip for fretting. The finger is sacrificed and makes the musician unable to play many standard and altered chords. Similarly, there are harmonic limitations with standard size slide bars, allowing only four out of a possible twelve intervals on a regularly tuned guitar.

Standard slide bars can cause difficulties in jumping between frets and excessive noise as the large surface area of the slide creates noise on adjacent strings. Even when the traditional tubular design is cut in half, or to a third of its regular size, the musician's finger flexibility is limited and the number of payable intervals is limited. There is no ability to change the size of the area on the slide that touches the strings.

Metal slide bars do not provide the same desirable acoustic properties of glass materials. Glass slide bars do not exhibit the same durability or have the same ease of manufacture as metal slides. Broken glass is hazardous to the musician's fingers.

The need exists for a safe and durable slide ring that exhibits the superior acoustic properties and that allows fingering of chords and an extended range of intervals.

DISCUSSION OF KNOWN ART

Many guitar slide devices found in prior art, as exemplified by U.S. design Pat. No. D324,532 to Pearse, are merely hand-held rather than finger-attached as disclosed herein; such hand-held slide devices generally leave the fingers unavailable for fretting, and also tend to introduce muscular fatigue from the continuous demand on the hand muscles, especially since they are typically relatively heavy.

Amongst finger-attached guitar slide devices found in prior art, many teach structure having a plurality of component parts, attachment to the finger via a ring that is attached onto one side of the actual slide bar and/or fail to provide the musician with the ability to vary the effective string-contact length of the slide bar, as exemplified in U.S. Pat. No. 6,111,177 to Patillo.

Amongst known guitar slide art disclosing one piece annular or tubular slide bar structure made to surround a finger in a coaxial manner, the classic glass bottle-neck slide e.g. U.S. Pat. No. 5,458,036 to Monaco for BOTTLENECK SLIDE BAR WITH SECTORS OF DIFFERENT MATERIALS along with U.S. Pat. No. 5,160,212 and Des. 434,065 to Morse for GUITAR SLIDE, exemplify such devices in known art that fail to disclose a key feature disclosed and taught herein: the capability of musician control over effective slide bar length. Furthermore many such single-size slide devices are made to extend beyond the fingertips, e.g. U.S. Pat. No. 5,515,762 to Perkins, or to otherwise fail to teach or show the present slide ring structure and the resultant unusual finger freedom along with length adjustment capability.

U.S. Des. 360,647 to Jimenez, shows a SLIDE GUIDE FOR GUITAR shows a compound structure having a ring-like portion with a prominent key-like portion extending longitudinally along a circumferential region. The drawings, necessarily taken per se, fail to explain the function and usage of the key-like region. Although FIGS. 3, 5 and 7 appear to show a small length variation around the ring circumference, it not clear whether this region is intended for use as a slide bar: even if that is the case, the very limited range would appear to be limited to a single string so the adjustment range would be no more than "fine tuning" of length of single string slide bar. The Jimenez structure would fail in several ways to enable the features and requirements addressed herein.

None of the foregoing or other known art teach or suggest the structure or functional capability of the present adjustable bar length slide ring, particularly when combined with glass coating.

OBJECTS OF THE INVENTION

It is the primary object of the present invention to provide a slide ring, to be deployed onto a musician's finger for use in playing a stringed musical instrument such as a guitar in a steel or slide style, that allows the musician to adjust the effective usable length of the slide bar during musical performance so as to vary the number of strings contacted, while retaining finger flexibility for additional fret stopping.

It is a further object that the slide ring be structured in a manner to allow a plurality of such slide rings to be deployed on adjacent fingers such that the additional finger flexibility provided enables slide stopping at different fret locations and thus provides the musician, depending on what is reachable, with the potential of playing up to 12 possible intervals on the guitar without retuning.

It is a further object to provide an embodiment of the slide ring wherein contact with the instrument strings is provided by a hard coating applied over at least a predetermined region of the body so as to provide substantially improved playing qualities, playing comfort, and superior appearance.

These and other objects and advantages of the present invention will become apparent from the following more detailed description, taken in conjunction with the accompanying drawings which illustrate the invention, by way of example.

SUMMARY OF THE INVENTION

The foregoing objects have met by a guitar slide ring that allows a guitar musician to play in a steel or slide style of effectively variable slide length while leaving the fingers flexible and free to be used in fingering strings and frets. In this text, the term ring is intended to cover a tubular shaped body that slides on to a finger. The present invention overcomes many of the disadvantages and limitations of traditional large and bulky slide guitar tools. The slide ring is configured with a tubular body having oppositely-angled end openings dimensioned to fit over the musician's finger in the region of the first and second knuckles leaving the fingertip exposed. Due to the combined angle between the inclined planes of the two end openings, the effective slide bar length applied to the strings can be adjusted to a desired amount by the musician by rotating the slide ring around the finger so as to increase or decrease the effective slide bar length in contact with the strings. Deploying multiple slide rings on adjacent fingers, with the slide bar lengths adjusted accordingly, the musician is capable of playing a larger number of intervals without retuning the instrument. With the musician's fingertips free, multiple chords and frets may be fingered as desired.

A desirable and improved acoustic response can be obtained from a basic metal body to which is bonded a glass coating with a smooth surface for contacting the strings. The metal body provides strong, robust, and safe slide device, protecting the musician's fingers from possible injury from chipped or broken glass. Exposed metal may be rounded and polished to fit ergonomically around the finger with maximum comfort. Aesthetic appearance is also improved with the glass coating, which may be colored, over a metal body.

As an alternative to glass-coating the entire surface of the body, the coating may be restricted to a predetermined portion, leaving an area of metal exposed for differing musical effects. The metal body may also be formed in shapes other than tubular, such as a U-shape or open top shape with extending tabs to rest on adjacent fingers.

As used herein, directional terms such as "top" are used with the understanding that while the instrument is often be held or played in various orientations, for present purposes the instrument is assumed to be oriented as shown in the drawings, i.e. with the strings and fingerboard running in a horizontal direction beneath the slide ring.

BRIEF DESCRIPTION OF THE DRAWINGS

The above and further objects, features, and advantages of the present invention will be more fully understood from the following description taken with the accompanying drawings in which.

DETAILED DESCRIPTION OF THE INVENTION

Figure 1:
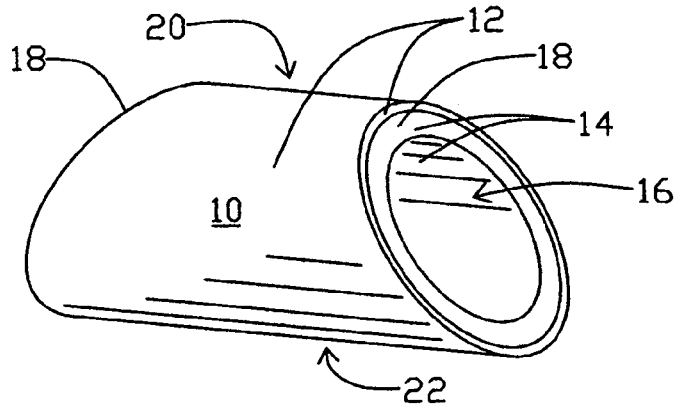
FIG. 1 is a three-dimensional view of an embodiment of the invention: a slide ring having a metal body with an outer glass coating.

FIG. 1 is a three-dimensional view of a glass-lined guitar slide ring 10 of the present invention, showing a basic metal body 14 with a glass outer coating 12. Body 14 is tubular in shape with a central tunnel 16 dimensioned to accept insertion of a musician's finger, typically as far as the first and second knuckle. The two opposite ends 18 of body 14 are inclined toward each other as shown in this view, so that the spacing between them is narrow at the top 20 and wide at the bottom 22. The edges of end openings 18 are contoured and rounded for the musician's comfort.

Figure 2:
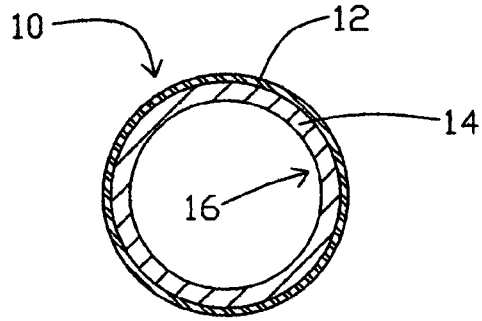
FIG. 2 is a cross-section taken at a mid-region of the slide ring of FIG. 1.

FIG. 2 is a cross-section taken at a mid-region of slide ring 10 of FIG. 1, showing glass coating 12 on body 14. The metal finish of central opening 16 is smoothed and polished to make a comfortable ring shape to fit on the musician's finger. The wall thickness of body 14 may range between 1 millimeters and 6 millimeters. The thickness of glass coating 12 may range between 1 millimeter and 4 millimeters, typically made to have a very smooth surface.

Alternatively, the internal surfaces around central opening 16 may be similarly glass-coated, and may be specially curved and shaped to provide a comfortable fit for the musician's finger.

Figure 3:
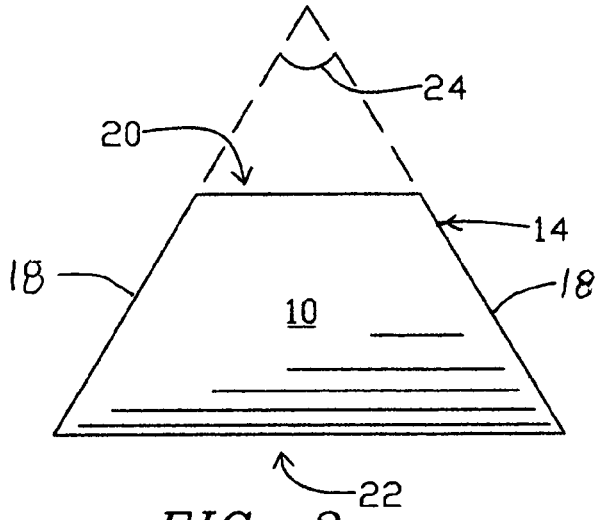
FIG. 3 is a side view of the slide ring of FIG. 1, showing the combined angle between the two oppositely-sloped ends.

FIG. 3 is a side view of slide ring 10 of FIG. 1, showing the angle 24 between the inclined planes of the two opposite end openings 18. Angle 24 may range between 10 degrees and 150 degrees. The resulting spacing between the end openings is short at the top 20, ranging between 5 millimeters and 200 millimeters, and relatively long at the bottom 22, ranging between 10 millimeters and 500 millimeters. Varying the effective slide bar length between the short top 20 and the long bottom 22 by rotationally adjusting the slide ring 20 around the finger allows a wide variety of intervals to be played in slide style on the strings.

Figure 4A:
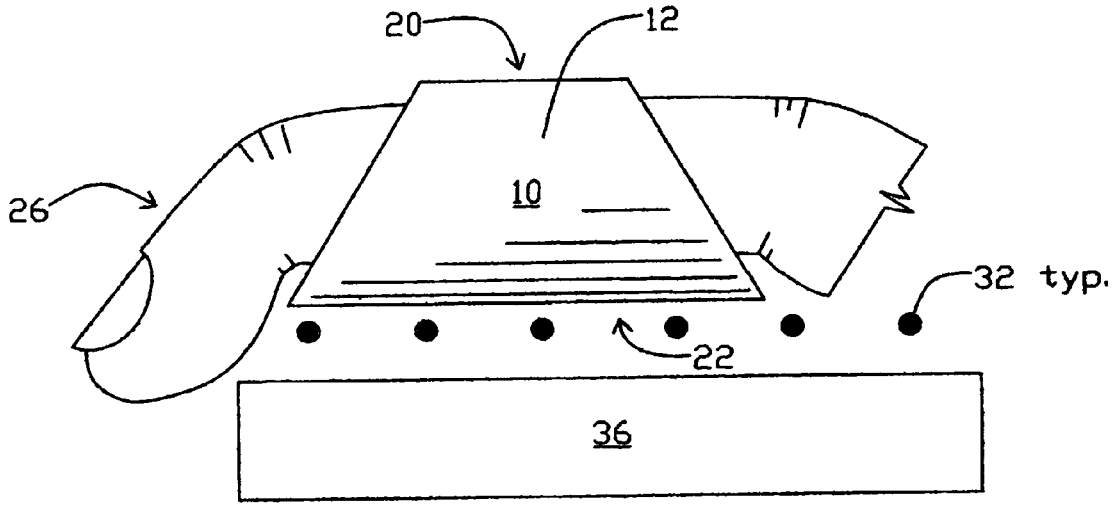
FIG. 4A is a side view of the slide ring of FIG. 1, rotationally positioned on a musician's finger so as to provide maximum effective slide bar length.

FIG. 4A is a side view of slide ring 10 of FIG. 1, positioned on the musician's finger 26, with long bottom 22 facing downwardly and short top 20 facing upwardly. When downward pressure is applied by the musician's finger 26, the glass coating 12 on the bottom surface of slide ring 10 is pressed into contact with the instrument strings 32 immediately above the instrument fingerboard 36. The long bottom 22 acts as a slide bar of maximum available length contacting the strings 32: the number of strings 32 contacted depends on the length of the bottom 22.

Figure 4B:
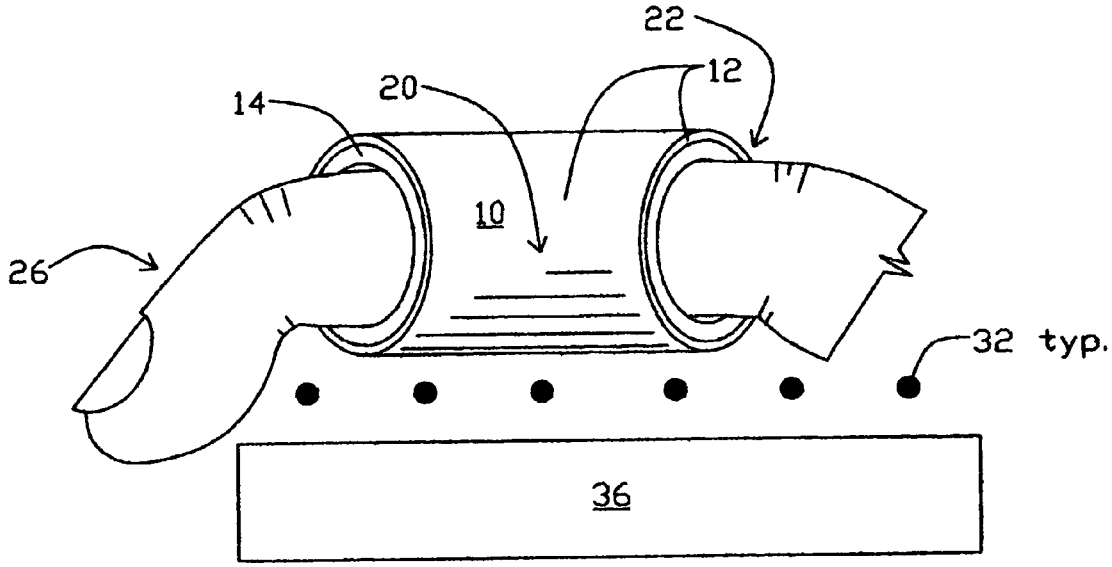
FIG. 4B is a side view as in FIG. 4A showing the slide ring rotationally repositioned on the musician's finger so as to provide intermediate effective slide bar length.

FIG. 4B is a top view of slide ring 10 of FIG. 1, positioned on musician's finger 26 and rotated from the position shown in FIG. 4, Long bottom 22 is facing back away from view. Short top 20 faces the viewer. When downward pressure is applied by musician's finger 26, pushing glass coating 12 on the outside of slide ring 10 in contact with instrument strings 32, a shorter portion of slide ring 10 contacts a smaller number of strings 32 above instrument fingerboard 36. Contact with fewer strings 32 by slide ring 10 allows a musician to play different intervals and produce various desirable musical effects. By rotating the slide ring 10 on the musician's finger 26, the effective slide bar length with contact between glass coating 12 and instrument strings may be manipulated by the musician.

Figure 5:
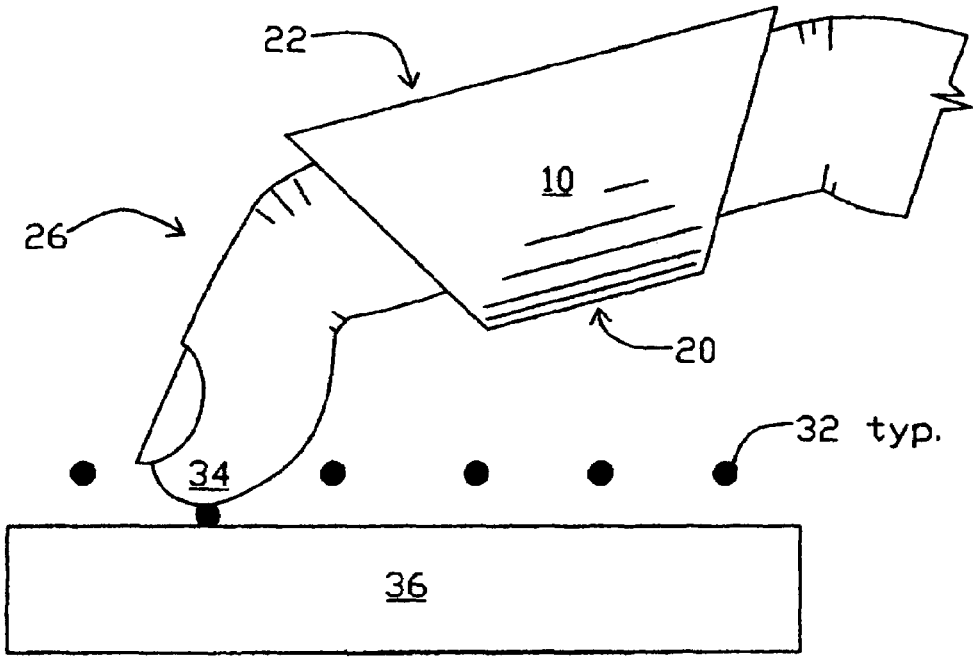
FIG. 5 is a side view of the slide ring of FIG. 1 rotationally positioned on a musician's finger so as to provide minimum effective slide bar length.

FIG. 5 is a side view of slide ring 10 of FIG. 1, positioned on the musician's finger 26 and rotated to allow free motion of musician's fingertip 34 to contact instrument strings 32. Long bottom 22 faces up and short top 20 faces down. In this position, the musician's finger 26 and fingertip 34 may move freely. This allows the musician to play various chords and press strings 32 against the fingerboard 36.

Figure 6:
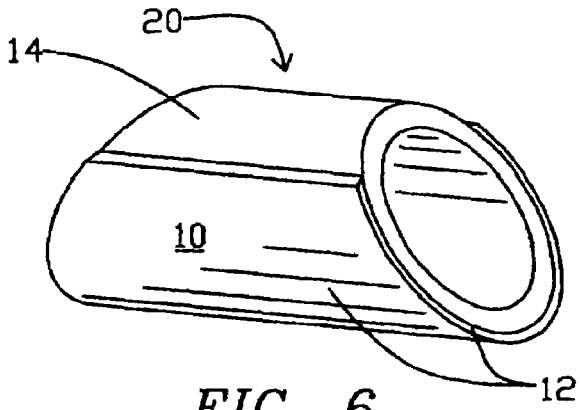
FIG. 6 is a three-dimensional view of a slide ring embodiment of the invention as in FIG. 1 but with the glass coating applied only to a major lower body portion.

FIG. 6 is a three-dimensional view of an alternate embodiment of the invention, with glass coating 12 on only a portion of slide ring 10. Metal body 14 is exposed on the short top 20.

Figure 7:
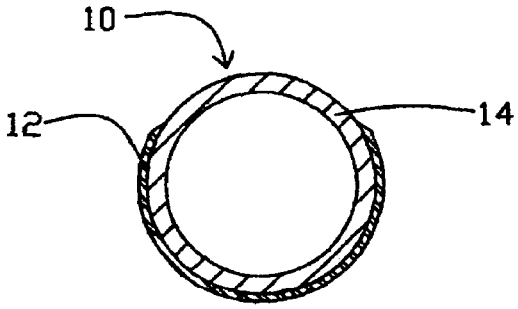
FIG. 7 is a cross-section taken at a mid-region of the slide ring of FIG. 6.

FIG. 7 is a cross-section taken at a mid-region of FIG. 6, showing glass coating 12 on body 14. Glass coating 12 only extends partially around slide ring 10.

Figure 8:
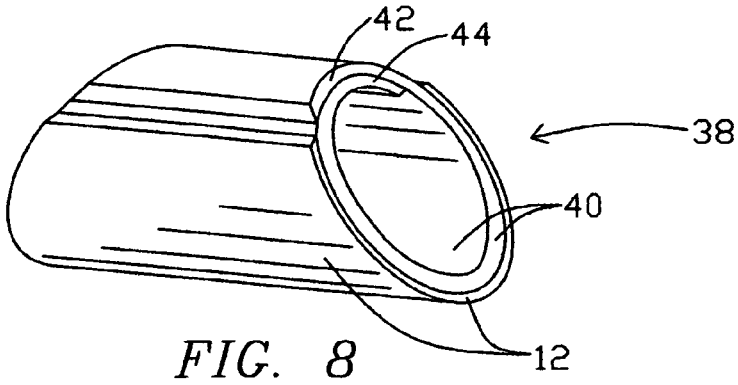
FIG. 8 is a three-dimensional view of a slide ring embodiment of the invention with diameter adjustment for finger size.

FIG. 8 is a three-dimensional view of an alternate embodiment of the invention, with an adjustable diameter slide ring 38. Metal base portion 40 is not made as a continuous cylinder. Instead, metal base 40 forms a cylinder shape with overlapping outer portion 42 and overlapping inner portion 44. Overlapping outer portion of metal base 40 slides circumferentially over overlapping inner portion 44, to adjust the diameter of the cylinder and conform to a musician's inserted finger (not shown). Glass coating 12 extends only partially around slide ring 38.

Figure 9:
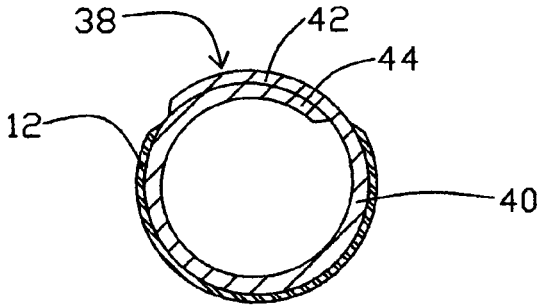
FIG. 9 is a cross-section taken at a mid-region of the slide ring of FIG. 8.

FIG. 9 is a cross-section taken at 9-9 in FIG. 8, showing glass coating 12 on the adjustable diameter slide ring 38. Overlapping outer portion 42 may slide circumferentially on overlapping inner portion 44 of metal base 40 to increase or decrease the diameter of slide ring 38.

Figure 10:
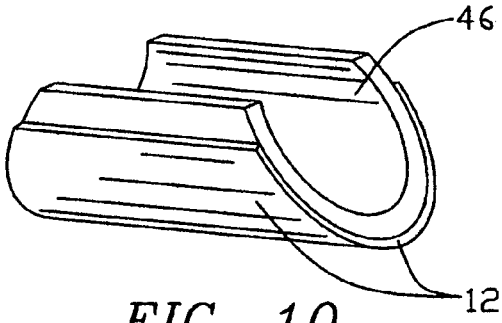
FIG. 10 is a three-dimensional view of a U-shaped slide ring embodiment of the invention.

FIG. 10 is a three-dimensional view of a U-shaped embodiment of the invention. Metal base 46 is U-shaped, made from a cylinder sectioned at the top to leave the top portion open. All edges are smoothed and rounded for comfort and safety. Glass coating 12 extends partially up the slides of metal base 46.

Alternatively, a Velcro fastening strap may be added to the top of the U-shaped embodiment, shown in FIG. 10, to improve retention of the slide ring on the musician's finger, providing additional comfort, stability and ease of use in playing.

Figure 11:
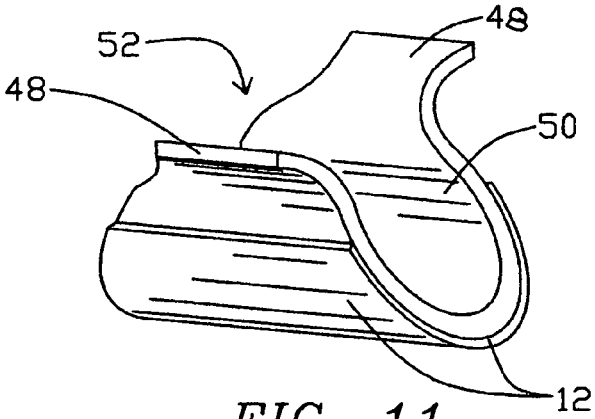
FIG. 11 is a three-dimensional view of a U-shaped slide ring embodiment of the invention configured with a pair of flared tabs extending to engage adjacent fingers.

FIG. 11 is a three-dimensional view of a U-shaped embodiment of the invention, with tabs 48 formed to extend from metal base 50 to cover adjacent fingers. Glass coating 12 is shown partially extending up the sides of metal base 50, covering wide bottom portion 52. Tabs 48 extend up and over adjacent fingers on musician's hand (not shown). Tabs 48 provide additional comfort and are conducive to a particular established type of slide guitar playing.

Alternatively, glass coating 12 may be applied to the entire surface of metal base 50 to provide a more comfortable fit for a musician's finger.

The length of the slide ring may be designated as a matter of design choice: increased length may be desired for a more traditional approach on lap steel or standard guitar with slightly improved mobility.

The hard smooth surfaces desired in particular regions may be formed from glass or similarly hard material including ceramic, jade and other stone-like coating.

As an alternative to smooth surfaces the invention may be implemented with matte surfaces in selected regions for purposes of increased friction relative to the player's skin. The matte surface may be provided by a variety of processes including sprayed-on material, etching or molding.

The invention may be embodied and practiced in other specific forms without departing from the spirit and essential characteristics thereof. The present embodiments are therefore to be considered in all respects as illustrative and not restrictive, the scope of the invention being indicated by the appended claims rather than by the foregoing description; and all variations, substitutions and changes which come within the meaning and range of equivalency of the claims are therefore intended to be embraced therein.

The invention claimed is:

1. A guitar slide ring, for contacting strings disposed near a fingerboard of a stringed musical instrument played by a musician in a slide style, comprising:

an annular slide ring body of rigid material disposed coaxially about a central axis and configured with a through-opening dimensioned internally to engage a finger of the musician as a ring, the central opening extending to a pair of end edges, disposed one at each opposite end of said body and separated incrementally by a distance, measured between the end edges along a potential line of string contact thus an effective slide bar length ranging between minimum and maximum and adjustable by the musician rotating said slide ring about the finger;

wherein said pair of end edges are shaped so as to be located in respective oppositely-inclined flat planes in mirror-image relationship about a plane perpendicular to the central axis, said end edges being thusly inclined equally in opposite directions and appearing in side view as a pair of straight oppositely-inclined lines extending between endpoints of a line at maximum slide bar length and corresponding endpoints of a diametrically opposite line at minimum slide bar length.

2. A guitar slide ring, for contacting strings disposed near a fingerboard of a stringed musical instrument slaved by a musician in a slide style, comprising:

an annular slide ring body of rigid material disposed coaxially about a central axis and configured with a through-opening dimensioned internally to engage a finger of the musician as a ring, the central opening extending to a pair of end edges, disposed one at each opposite end of said body and separated incrementally by a distance, measured between the end edges along a potential line of string contact thus an effective slide bar length ranging between minimum and maximum and adjustable by the musician rotating said slide ring about the finger;

wherein said annular body is tubular in shape, made from metal and further comprises a glass coating bonded onto at least a predetermined surface portion thereof using a process selected from a group including lamination, baking, firing, and molecular bonding, so as to provide a desirable hard smooth string-contacting slide bar surface for improved acoustic playing properties.

3. The guitar slide ring as defined in claim 1 wherein the maximum effective bar length is made to be in a range between 4" (10.2 cm) and 0.31" (8 mm) and the minimum effective bar length is made to be less than the maximum bar length and in a range between 1.9" (4.8 cm) and 0.15" (4 mm).

4. The guitar slide ring as defined in claim 3, wherein the maximum effective slide bar length is made to be 1.5" (3.8 cm)+/−10%, and the minimum effective bar length is made to be 0.25" (6.3 mm)+/−10% so as to approximate a typical guitar fret length and string spacing respectively and thus enable the musician to play a maximum number of intervals.

5. The guitar slide ring as defined in claim 1, wherein said openings and the inner surfaces of said tubular body are shaped and smoothed to provide a comfortable fit on the musician's finger.

6. The guitar slide ring as defined in claim 1, wherein a predetermined inner surface region of said annular body is textured in a manner to provide high friction between said guitar slide ring and the musician's finger.

7. The guitar slide ring as defined in claim 1, wherein said annular body is fabricated from a material selected from a group including: metal, polymer, glass, and ceramic.

8. The guitar slide ring as defined in claim 2, wherein said glass coating is epoxy based with glass impregnation.

9. The guitar slide ring as defined in claim 2, wherein said glass coating is a ceramic material.

10. The guitar slide ring as defined in claim 2, wherein said glass coating is colored to provide aesthetic appeal.

11. The guitar slide ring as defined in claim 2, wherein said glass coating is made to cover only a predetermined portion of said tubular body, exposed portions thereof being polished to provide overall smoothness.

12. The guitar slide ring as defined in claim 2, wherein said glass coating is made to completely cover said tubular body, coating both inner and outer surfaces.

13. The guitar slide ring as defined in claim 2, wherein the outer exposed surface of said glass coating and said tubular body are textured to provide a high friction surface for gripping said guitar slide device.

14. The guitar slide ring as defined in claim 1, wherein said body is configured with a generally rectangular overlapping region of double thickness extending between the two end edges extending from end to end of said annular body, thereby enabling adjustment of said guitar slide ring regard to diameter to match a musician's finger size.

15. The guitar slide ring as defined in claim 1, wherein a designated sector of said body is cut out of the body circumference, thus flanking a musician's finger between two sidewalls and exposing a portion of the finger along a longitudinal void.

16. The guitar slide ring as defined in claim 15, further comprising a pair of tabs formed as extensions of the sidewalls and positioned to curve over adjacent fingers of the musician for comfort, stability and ease of use in playing.

17. The guitar slide ring as defined in claim 15, further comprising a Velcro strap attached to the sidewalls and positioned to wrap over the musician's finger for retention, stability, comfort, and ease of use in playing.

18. The guitar slide ring as defined in claim 3, wherein said body is made from brass and made to have a polished surface.

19. The guitar slide ring as defined in claim 2 wherein said glass coating is made to have a designated color.

20. The guitar slide ring as defined in claim 1, wherein said annular body is tubular in shape, made from metal and further comprises a coating bonded onto at least a predetermined surface portion thereof, so as to provide a desirable hard smooth string-contacting slide bar surface for improved acoustic playing properties, said coating being made to have a designated color.

21. The guitar slide ring as defined in claim 2 further comprising an ornamental image located under the glass coating and made visible through the glass coating.

22. The guitar slide ring as defined in claim 10 further comprising an ornamental image located under the coating and made visible through the coating.

23. The guitar slide ring as defined in claim 6 wherein the high friction is obtained by texturing the predetermined inner surface region to have a matte finish applied in a process selected from a group that includes spraying on material, etching and molding.

* * * * *